US005297928A

United States Patent [19]

Imakiire et al.

[11] Patent Number: 5,297,928

[45] Date of Patent: Mar. 29, 1994

[54] CENTRIFUGAL COMPRESSOR

[75] Inventors: Koichiro Imakiire; Keiichi Shiraishi; Masanori Kimura; Masayoshi Tagawa, all of Nagasaki, Japan

[73] Assignee: Mitsubishi Jukogyo Kabushiki Kaisha, Tokyo, Japan

[21] Appl. No.: 898,402

[22] Filed: Jun. 15, 1992

[51] Int. Cl.[5] ..... F01D 11/00

[52] U.S. Cl. ..... 415/112; 415/170.1; 415/115

[58] Field of Search ..... 415/104, 106, 110, 112, 415/115, 170.1

[56] References Cited

U.S. PATENT DOCUMENTS

| | | | |
|---|---|---|---|
| 1,910,811 | 5/1933 | Peterson | 415/170.1 |
| 1,990,519 | 2/1935 | Bigelow et al. | 415/112 |
| 2,013,499 | 9/1935 | Meckenstock | 415/112 |
| 2,925,290 | 2/1960 | Greenwald | 415/170.1 |
| 3,350,059 | 10/1967 | Sproule | 415/170.1 |
| 3,650,634 | 3/1972 | Osborne et al. . | |
| 4,236,867 | 12/1980 | Morris | 415/112 |
| 4,286,919 | 9/1981 | Yamaguchi | 415/112 |
| 4,882,902 | 11/1989 | Reigel et al. | 415/115 |

FOREIGN PATENT DOCUMENTS

| | | | |
|---|---|---|---|
| 0184880 | 3/1954 | Austria | 415/112 |
| 249336 | 3/1911 | Fed. Rep. of Germany . | |
| 379125 | 10/1907 | France . | |
| 1008491 | 3/1983 | U.S.S.R. | 415/106 |

*Primary Examiner*—Edward K. Look
*Assistant Examiner*—Mark Sgantzos
*Attorney, Agent, or Firm*—Wenderoth, Lind & Ponack

[57] ABSTRACT

A centrifugal compressor has a plurality of seals arranged at the back of an impeller for sealing the impeller outlet and form an annular space defined at the back of the impeller. The annular space is fed with a cold gas under a higher pressure than that of the air discharged at the impeller outlet. Thus, the back of the impeller is cooled down.

6 Claims, 4 Drawing Sheets

CENTRIFUGAL COMPRESSOR

BACKGROUND OF THE INVENTION

1. Field of the Invention

The present invention relates to a centrifugal compressor to be applied, for example, as a supercharger of an engine.

2. Description of the Prior Art

FIG. 3 shows a longitudinal section of a centrifugal compressor of the prior art, and FIG. 4 illustrates the operation of the same. A labyrinth packing 5 is sandwiched between the back of an impeller 1 of the centrifugal compressor and a casing 12. The labyrinth packing 5 seals a space 7 by being located between the outlet and back of the impeller 1. The space 7 is vented to the outside through a ventilation hole 8 for releasing a slight amount of air, which comes into the space 7 along the labyrinth packing 5, to the outside to thereby decrease the pressure in the space 7. As a result, the pressurized air leaking from the outlet of the impeller 1 to the back of the impeller 1 is prevented from establishing a thrust pushing a rotor shaft 2 in a direction toward the inlet of the impeller 1. Thus, the facial pressure on a main thrust bearing 3 is lowered to lighten the load upon the main thrust bearing 3. Reference numerals 11 and 4 designate a thrust collar and a thrust bearing, respectively.

In the existing centrifugal compressor described above, the air temperature at the outlet of the impeller 1 becomes higher with a higher pressure ratio of the centrifugal compressor. Even when air at the room temperature is aspirated, for example, its temperature reaches 200° C. or more at the outlet of the impeller 1 if the pressure ratio is about 4.0. This hot air is additionally heated, while passing through the labyrinth packing 5, by the heat of friction which is produced by the rotations of the fins of the labyrinth packing 5. Thus, the back of the impeller 1 is heated. The centrifugal compressor of this single stage type intaking the atmospheric air usually has its impeller made of an aluminum alloy, and the impeller 1 is degraded due to its temperature rise when heated by the air at its back. This makes it difficult to retain a high pressure ratio if the impeller is made of an aluminum alloy. The temperature rise of the impeller 1 in turn leads to a rise in the air temperature, thus causing an efficiency drop of the compressor.

SUMMARY OF THE INVENTION

An object of the present invention is to provide a centrifugal compressor which can solve the above-described problem.

According to the present invention, there is provided a centrifugal compressor which comprises: an impeller; annular seal members at the back of the impeller for sealing the outlet of the impeller from an annular space defined to the back of the impeller; and a passage through which cold gas under a higher pressure than that at the outlet of the impeller is fed into said annular space.

In the centrifugal compressor according to the present invention, because the cold gas fed through the passage has a higher pressure than that at the outlet of the impeller, the hot gas at the impeller outlet is prevented from flowing into the space at the back of the impeller. On the other hand, a small amount of cold gas will flow out of the space toward the impeller outlet. As a result, the back of the impeller is not heated by the gas at the impeller outlet but is cooled by the cold gas fed through the passage.

BRIEF DESCRIPTION OF THE DRAWINGS

Other objects, features and advantages of the present invention will become apparent from the following description made with reference to the accompanying drawings, in which.

DETAILED DESCRIPTION OF THE PREFERRED EMBODIMENT

Figure 1:
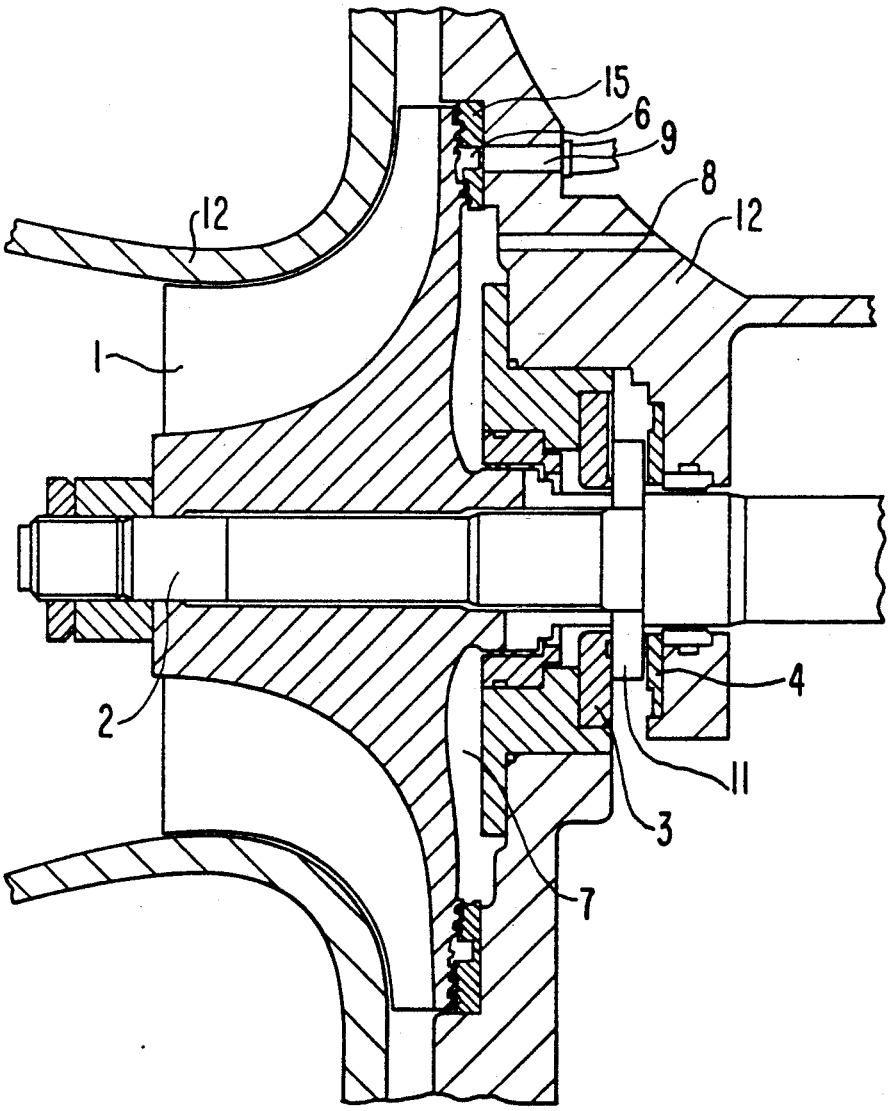
FIG. 1 is a longitudinal sectional view of one embodiment of a centrifugal compressor according to the present invention.
Figure 2:
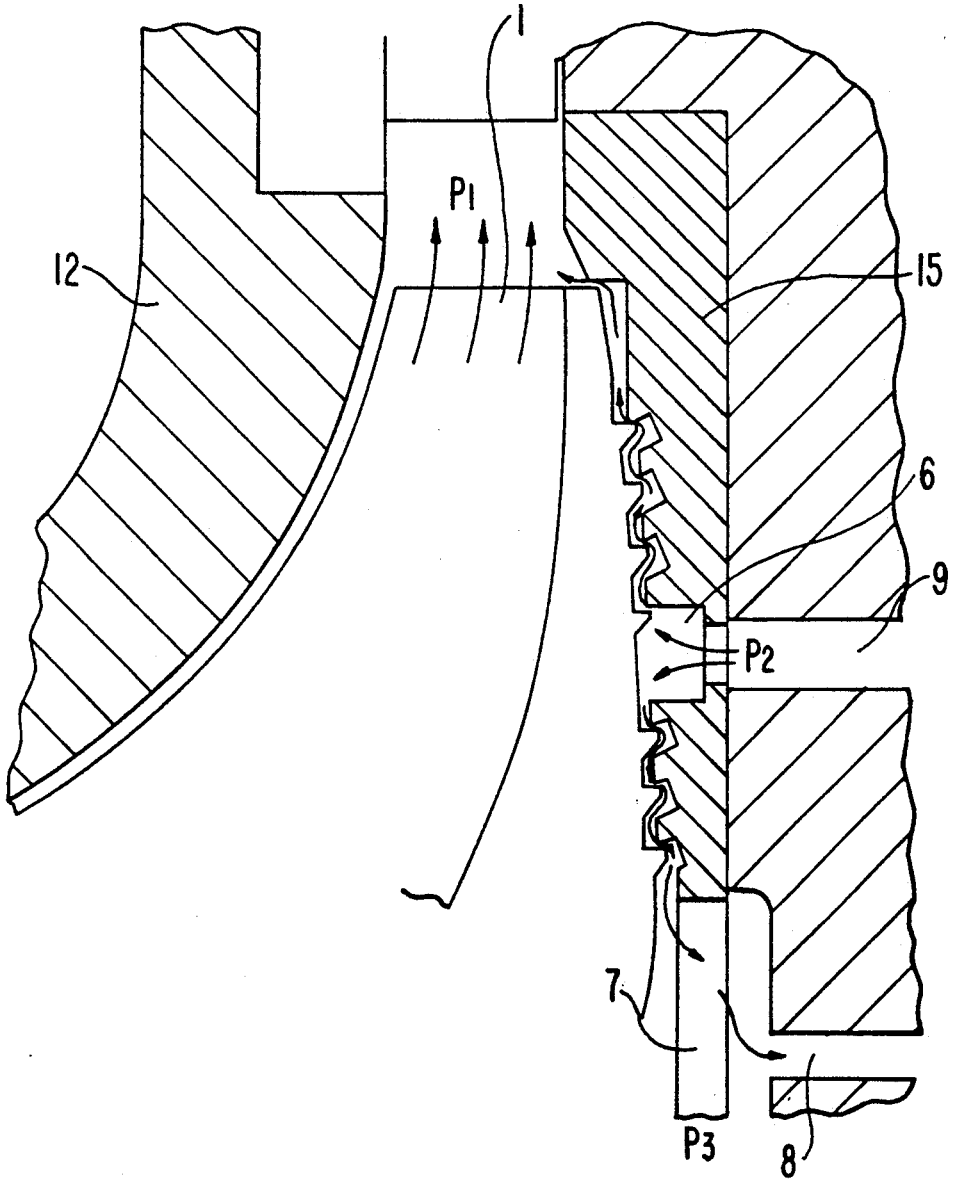
FIG. 2 is an enlarged view of a portion of the compressor illustrating the operation of the same.
Figure 3:
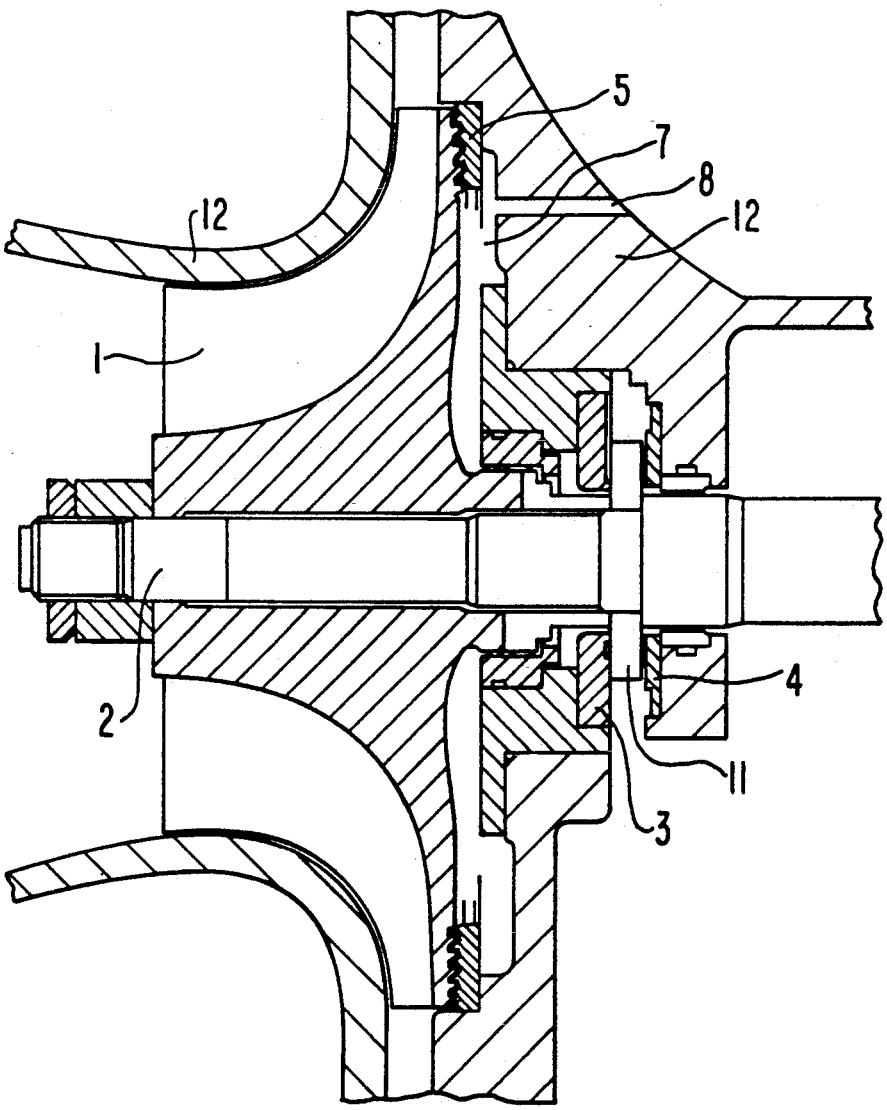
FIG. 3 (PRIOR ART)
FIG. 3 is a longitudinal sectional view of a centrifugal compressor of the prior art.
Figure 4:
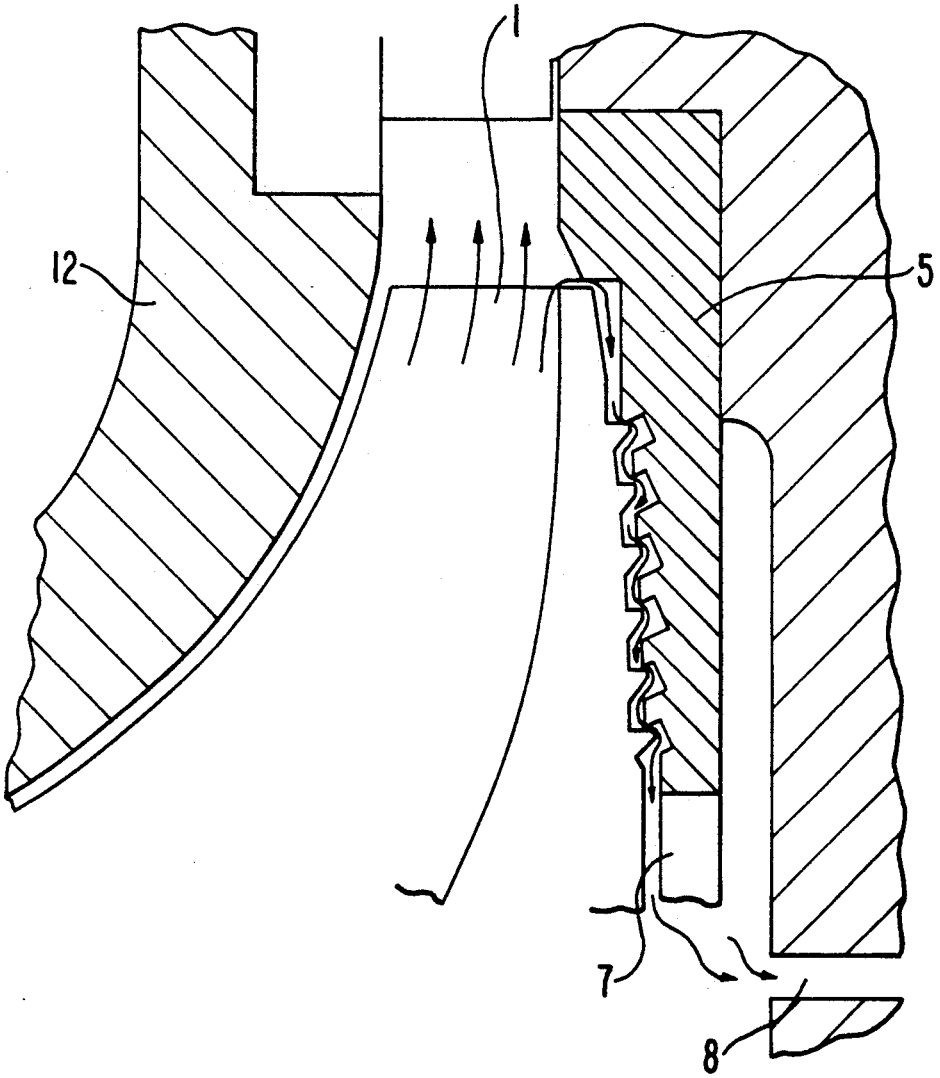
FIG. 4 (PRIOR ART)
FIG. 4 illustrates the operation of the prior art compressor.

FIG. 1 shows the structure of one embodiment of a centrifugal compressor according to the present invention, and FIG. 2 illustrates the operation of the centrifugal compressor. As shown, the centrifugal compressor according to the present embodiment is used as a supercharger of an engine. Between the back of an impeller 1 and a casing 12, as shown in FIG. 1, there is sandwiched a labyrinth packing 15 for sealing space 7 from the outlet of the impeller 1. The space 7 is vented to the outside through a ventilation hole 8 for releasing a slight amount of air, which comes into the space 7 along the labyrinth packing 15, to the outside thereby decreasing the pressure in the space 7. As a result, the pressurized air at the outlet of the impeller 1 is prevented from leaking to the back of the impeller 1 and accordingly from establishing a thrust pushing a rotor shaft 2 in a direction toward the inlet of the impeller 1. Thus, the facial pressure upon a main thrust bearing 3 is relieved to mitigate the load exerted on the main thrust bearing 3. Reference numerals 11 and 4 designate a thrust collar and a thrust bearing, respectively.

The air temperature at the outlet of the impeller 1 is higher with a higher pressure ratio of the centrifugal compressor. Even when air at room temperature is aspirated, for example, its temperature reaches 200° C. or more at outlet of the impeller 1 if the pressure ratio is about 4.0. In order for the back of the impeller 1 to be prevented from being heated by that hot air, the labyrinth packing 15 of the present centrifugal compressor has its fins divided into outer and inner groups, which form an annular space 6 therebetween. Labyrinth packing 15 has two portions located at the radially innermost and outermost portions of the annular space 6. This annular space 6 is fed, as better seen from FIG. 2, with cold air from the outside through an air passage 9. The cold air has a higher pressure $P_2$ than a pressure $P_1$ at the outlet of the impeller 1. Generally speaking, the air having left the centrifugal compressor has a higher pressure than that $P_1$ at the outlet of the impeller 1, like the compressed cold air under a high pressure to be fed from the supercharger through a cooler to the engine. Accordingly, a portion of the compressed air cooled down by an engine air cooler is fed through passage 9. Thus, this cooled air will be guided to the labyrinth packing 15 at the back of the impeller 1.

At the labyrinth packing at the back of the impeller of the prior art centrifugal compressor, the air in the sealed space 7 is released to reduce the pressure in the space and so a small amount of the air at the impeller outlet will pass through the labyrinth packing. On the contrary, the labyrinth packing 15 of the present centrifugal compressor has outer and inner groups of fins and its intervening annular space 6 is fed with the air under a pressure $P_2$ that is higher than the pressure $P_1$ at the outlet of the impeller 1. The air having the higher pressure $P_2$ is thus fed so that the air at the outlet of the impeller 1 will not flow along the labyrinth packing 15 into the annular space 6. To the contrary, a small amount of air fed to the annular space 6 will flow toward the outlet of the impeller 1. As a result, the back of the impeller 1 is not exposed to and accordingly heated by the air, which might otherwise flow from the outlet of the impeller 1, but is cooled by the cold air fed from the outside via the air passage 9. Thus, a rise in the temperature of the impeller 1 is suppressed so that its strength is prevented from being degraded. Incidentally, although the space 7 at the back of the impeller 1 and the annular space 6 are sealed by the labyrinth packing 15, the air flow, if any, to the space 7 is discharged through the ventilation hole 8 to decrease the pressure $P_3$ in the space 7. Thus, the load upon the main thrust bearing 3 is not increased due to a balancing of the thrust in a manner unlike that which occurs in the centrifugal compressor of the prior art.

According to the aforementioned structure of the centrifugal compressor of the present invention, the back of the impeller is not heated by gas flowing from the impeller outlet but is cooled by cold gas. As a result, a high pressure ratio can be retained even if the impeller is made of an aluminum alloy, and the temperature of the gas to be compressed by the impeller can be dropped to raise the compression efficiency.

What is claimed is:

1. A centrifugal compressor comprising: an impeller having an outlet through which gas is discharged; a fixed structure disposed to the back of said impeller in the compressor, the back of said impeller and said fixed structure defining a space therebetween; a labyrinth seal including fins forming a labyrinth of the seal, said seal defining an annular space between respective groups of said fins, and said seal being interposed between the outlet of said impeller and said space; and said fixed structure having a passage extending therethrough and open to the labyrinth of said seal via said annular space defined between respective groups of the fins of said seal, whereby cold gas under a higher pressure than that at the outlet of the impeller can be fed into the annular space through the passage.

2. A centrifugal compressor as claimed in claim 1, wherein said labyrinth seal is a one-piece member having portions disposed at radially innermost and radially outermost portions of said annular space, respectively.

3. A method of cooling a centrifugal compressor, said method comprising the steps of:

sealing the outlet of an impeller of the compressor from a space defined at and delimited by the back of the impeller; and cooling the back of the impeller by feeding cold gas under a pressure higher than that of gas at the outlet of the compressor into the space defined at the back of the impeller.

4. A method of cooling a centrifugal compressor as claimed in claim 3, wherein the step of cooling comprises feeding cold gas from an engine air cooler into the space.

5. A method of cooling a centrifugal compressor as claimed in claim 3, wherein the step of sealing comprises interposing a labyrinth seal having a plurality of fins between the outlet of the impeller and the space at the back of the impeller, and the step of cooling comprises feeding cold gas to a location between respective groups of the fins of the labyrinth seal.

6. A method of cooling a centrifugal compressor as claimed in claim 4, wherein the step of sealing comprises interposing a labyrinth seal having a plurality of fins between the outlet of the impeller and the space at the back of the impeller, and the step of cooling comprises feeding cold gas to a location between respective groups of the fins of the labyrinth seal.

* * * * *